US005702134A

United States Patent [19]

Hsieh

[11] Patent Number: 5,702,134

[45] Date of Patent: Dec. 30, 1997

[54] DOOR LOCK SYSTEM

[75] Inventor: Chun-Kun Hsieh, Taipei Hsien, Taiwan

[73] Assignee: Ming Wei Industrial Co., Ltd., Taipei Hsien, Taiwan

[21] Appl. No.: 724,760

[22] Filed: Oct. 3, 1996

[51] Int. Cl.[6] ..... E05B 65/10

[52] U.S. Cl. ..... 292/92; 292/21; 292/DIG. 60

[58] Field of Search ..... 292/92, DIG. 60, 292/21, 306

[56] References Cited

U.S. PATENT DOCUMENTS

| | | | |
|---|---|---|---|
| 4,881,765 | 11/1989 | Heid | 292/DIG. 60 |
| 5,042,851 | 8/1991 | Hunt | 292/21 |
| 5,088,786 | 2/1992 | Linder | 292/92 |
| 5,154,454 | 10/1992 | Hollaway | 292/92 |
| 5,427,420 | 6/1995 | Moore | 292/92 |
| 5,527,074 | 6/1996 | Yeh | 292/21 |

*Primary Examiner*—Steven N. Meyers
*Assistant Examiner*—Gary Estremsky
*Attorney, Agent, or Firm*—Jacobson, Price, Holman & Stern, PLLC

[57] ABSTRACT

A door lock system including a control mechanism transversely mounted in a door in the middle, a transmission mechanism mounted in one hollow stile at one lateral side of the door and coupled to one end of the control mechanism at right angles, a top latch assembly and a bottom latch assembly respectively fastened to the hollow stile at difference elevations and driven by the control mechanism through the transmission mechanism to secure to the door to a doorframe, the top latch assembly including a shell fixed to the hollow stile on the inside, a frame mounted inside the shell, a latch bolt pivoted to the shell, a push member pivoted to the frame and driven to move the latch bolt, an adjustment device driven by the transmission mechanism to move the push member, and a locating device mounted in the frame and controlled by a fine adjustment device to secure the actuating device to the frame.

4 Claims, 8 Drawing Sheets

DOOR LOCK SYSTEM

BACKGROUND OF THE INVENTION

The present invention relates to door lock systems, and relates more particularly to such a door lock system which comprises a control mechanism transversely mounted in a door in the middle, a transmission mechanism mounted in one hollow stile at one lateral side of the door and coupled to one end of the control mechanism at right angles, a top latch assembly and a bottom latch assembly respectively fastened to the hollow stile at difference elevations and driven by the control mechanism through the transmission mechanism to secure to the door to a doorframe, the top latch assembly including a shell fixed to the hollow stile on the inside, a frame mounted inside the shell, a latch bolt pivoted to the shell, a push member pivoted to the frame and driven to move the latch bolt, an adjustment device driven by the transmission mechanism to move the push member, a locating device mounted in the frame and controlled by a fine adjustment device to secure the actuating device to the frame.

FIGS. 2 show a door lock system according to the prior art. This structure of door lock system comprises a control mechanism 10 transversely mounted in the door 90 in the middle which comprises a movable pressure plate 12 and a linking mechanism 13 coupled to the movable pressure plate 12, a transmission mechanism 20 mounted in one hollow stile 91 of the door 90 and coupled to one end of the linking mechanism 13 at right angles which comprises a gear seat 21 and two transmission rods 23 vertically connected to the gear seat 21 in reversed directions, a top latch assembly 1045 mounted inside the hollow stile 91 near the top and having a pivoted latch bolt 1047, a bottom latch assembly 1046 mounted inside the hollow stile 91 near the bottom and having a movable bolt 1048 coupled to one transmission rod 23 at the bottom, a hollow locating rod 1044 fastened to one transmission rod 23 at the top and having a screw holder 108 at the top, an actuating rod 105 inserted through the hollow locating rod 1044 and stopped below the latch bolt 1047, and an adjustment device 106 fixedly secured to the actuating rod 105 and having an adjustment screw 107 adjustably fastened to the screw holder 108. Because the actuating rod 105 is mounted in the hollow locating rod 1044, a screwdriver must be inserted into the top latch assembly 1045 inside the hollow stile 91 so that the adjustment screw 107 can be turned to adjust the elevation of the actuating rod 105 relative to the latch bolt 1047. The precision of the mechanical parts is critical so that the actuating rod 105 can be positively inserted into the hollow locating rod 1044 when the adjustment screw 107 is fixed to the screw hole 108. Furthermore, it is difficult to adjust the position of the actuating rod 105, because the adjustment can be checked only by means of the sense of touch.

SUMMARY OF THE INVENTION

The present invention has been accomplished to provide a door lock system which eliminates the aforesaid drawbacks. According to one aspect of the present invention, the door lock system comprises a control mechanism transversely mounted in a door in the middle, a transmission mechanism mounted in one hollow stile at one lateral side of the door and coupled to one end of the control mechanism at right angles, a top latch assembly and a bottom latch assembly respectively fastened to the hollow stile at difference elevations and driven by the control mechanism through the transmission mechanism to secure to the door to a doorframe, the top latch assembly including a shell fixed to the hollow stile on the inside, a frame mounted inside the shell, a latch bolt pivoted to the shell, a push member pivoted to the frame and driven to move the latch bolt, an adjustment device driven by the transmission mechanism to move the push member, and a locating device mounted in the frame and controlled by a fine adjustment device to secure the actuating device to the frame. When the control mechanism is depressed, the latch bolt of the top latch assembly is turned downwards and received inside the hollow stile, and a tool can then be inserted through a hole in the hollow stile to turn the fine adjustment device for permitting the movable rod of the actuating device to be adjusted to the desired elevation. According to another aspect of the present invention, the locating device is comprised of a first locating plate, and a second locating plate. The first locating plate comprises a vertical section inserted into the frame of the top latch assembly, a coupling slot in the vertical section, a horizontal section extending from a bottom side of the vertical section at right angles, a through hole and a screw hole spaced in the horizontal section. The screw hole of the horizontal section is fixedly secured to the frame of the top latch assembly by a screw. The second locating plate comprises a vertical section inserted into the frame of the top latch assembly, an upright extension strip extending from a top side of the vertical section, a horizontal section extending from a bottom side of the vertical section at right angles and inserted into the coupling slot of the first locating plate, and a through hole aligned with the through hole of the first locating plate. The upright extension strip of the second locating plate is stopped at the fine adjustment device. When the fine adjustment device is turned outwards, the movable rod of the actuating device is released from the locating device and can be adjusted to the desired elevation. According to still another aspect of the present invention, the top latch assembly further comprises a side plate adapted for fastening to the frame thereof at one side. The side plate comprises a plurality of screw holes adapted for fastening to respective screw holes in the frame of the top latch assembly by respective screws, and a fine adjustment hole aligned with the fine adjustment hole in the frame of the top latch assembly and adapted for receiving the fine adjustment device.

DETAILED DESCRIPTION OF THE PREFERRED EMBODIMENT

Figure 1:
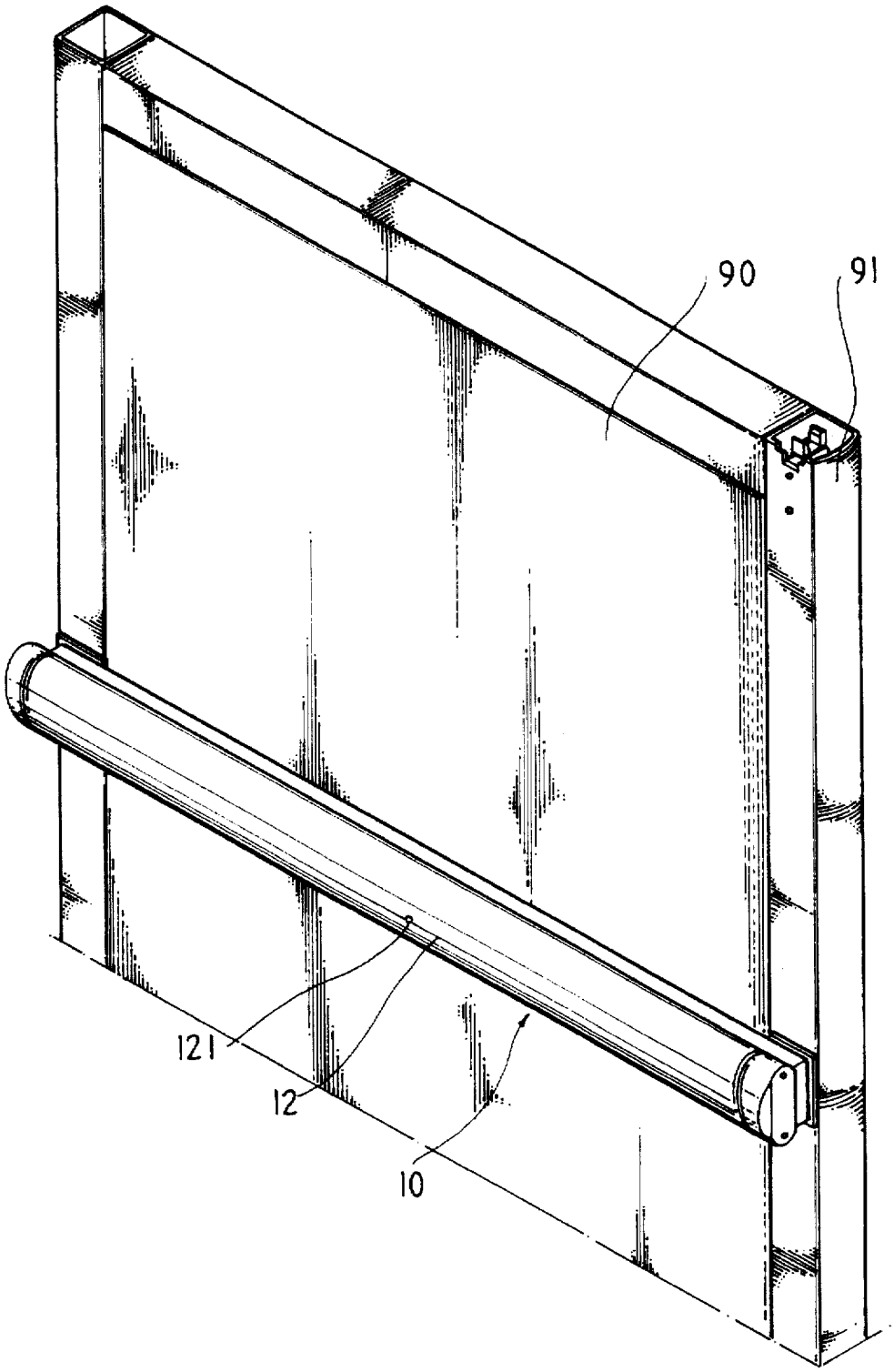
FIG. 1 shows a door lock system installed in a door.
Figure 2:
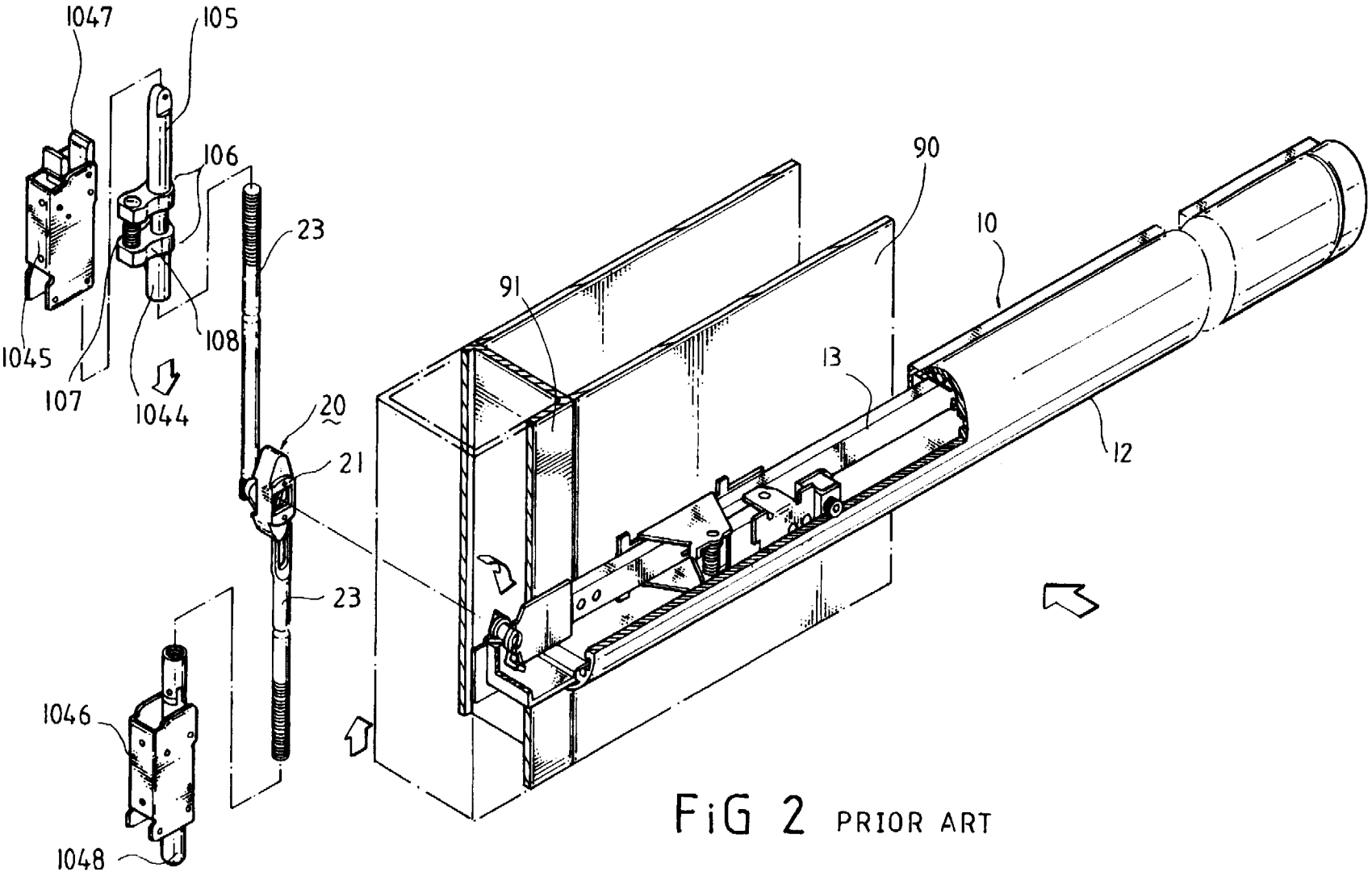
FIG 2 PRIOR ART
FIG. 2 is an exploded view of the door lock system according to the prior art.
Figure 3:
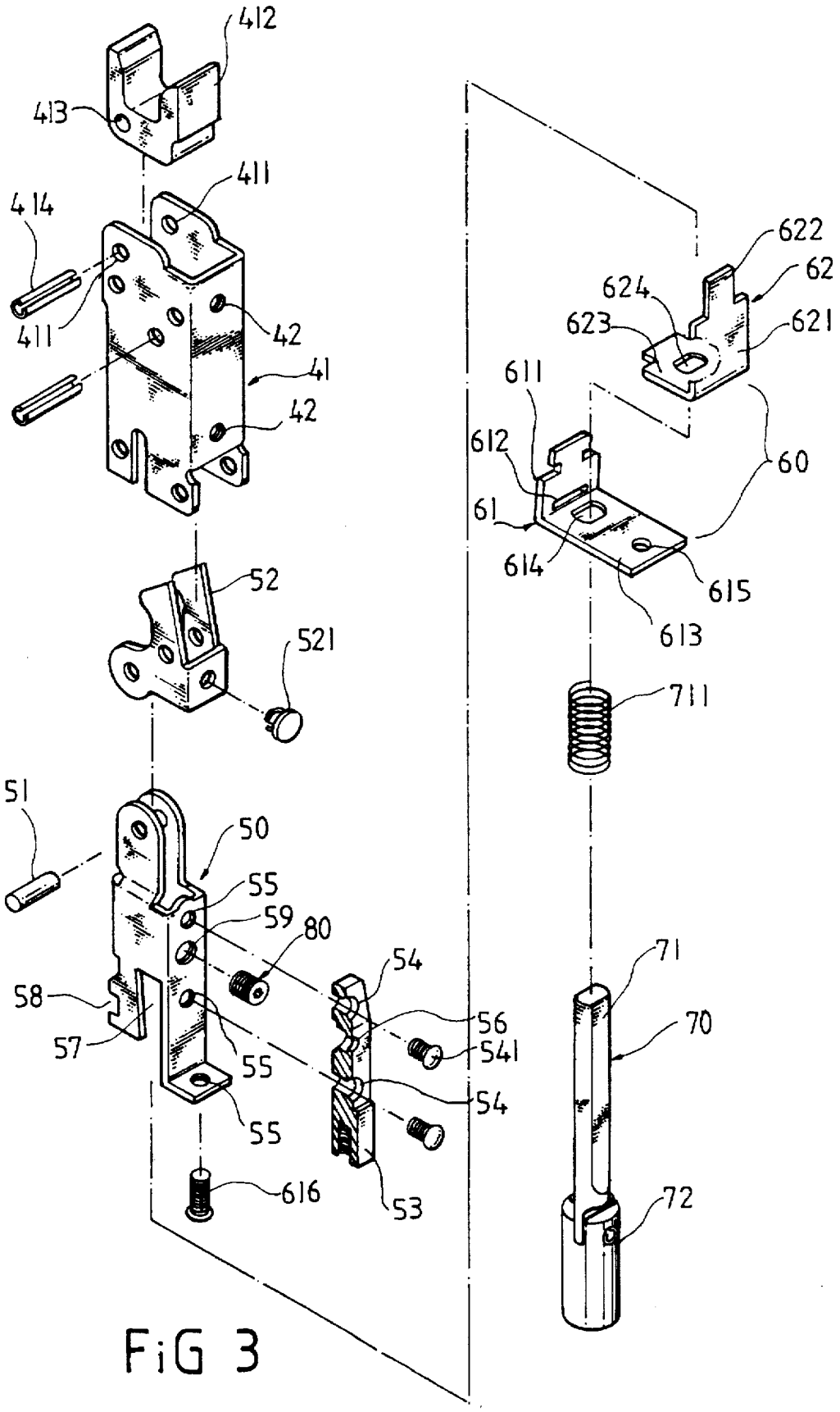
FIG. 3 is an exploded view of a top latch assembly according to the present invention.
Figure 4:
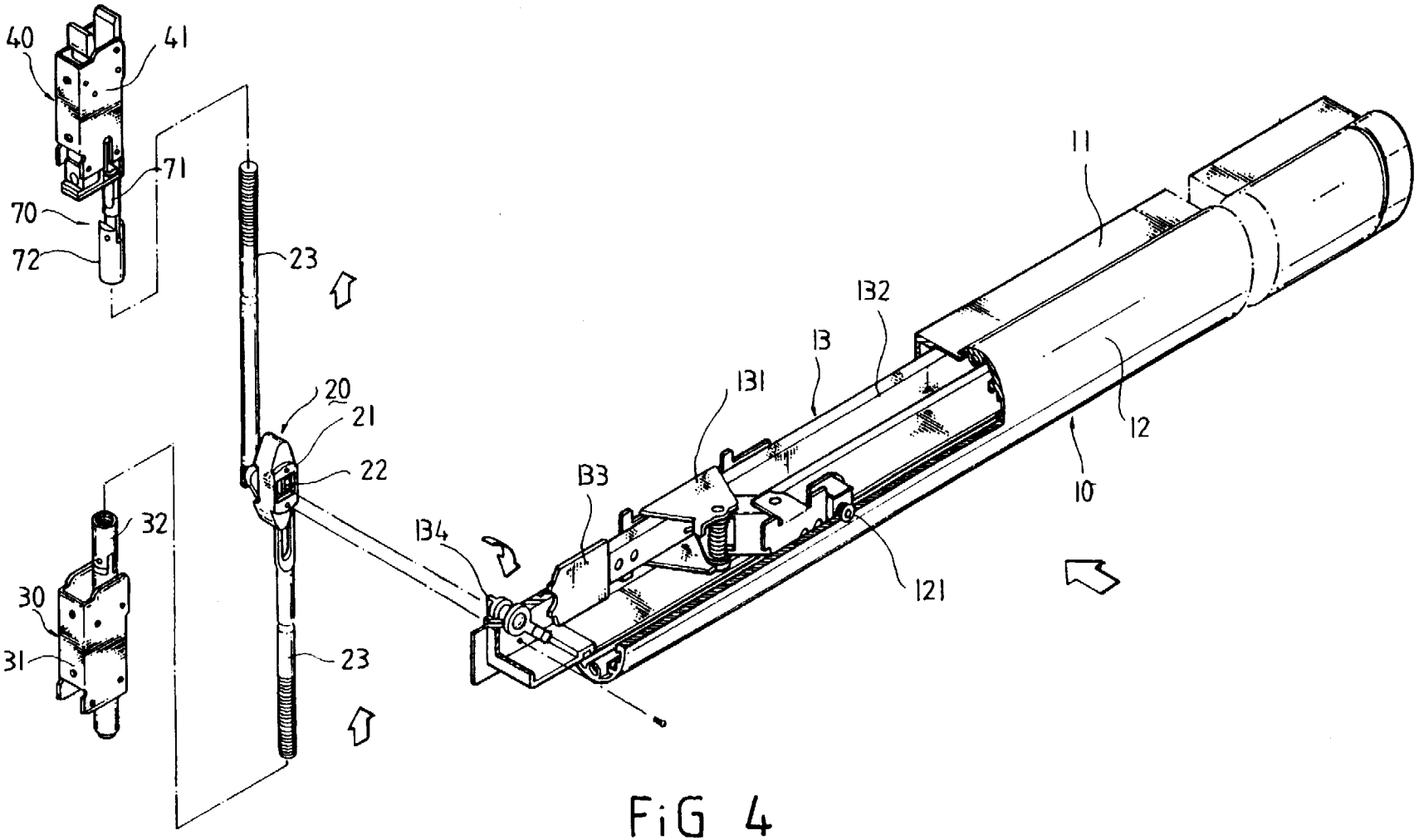
FIG. 4 is an exploded view of a door lock system according to the present invention.

Referring to FIGS. 1, 3, and 4, a door lock system in accordance with the present invention is generally comprised of a control mechanism 10, a transmission mechanism 20, a control mechanism 10, a bottom latch assembly 30, and a top latch assembly 40.

The control mechanism 10 comprises an elongated casing 11 fixedly mounted on the door 90 in a horizontal position, a movable pressure plate 12 coupled to the casing 11 and having a lock hole 121, and a linking mechanism 13 mounted inside the casing 11 and coupled to the movable pressure plate 12. The linking mechanism 13 comprises two link holders 131 fixedly mounted inside the casing 11 near two opposite ends, a link 132 movably mounted in the link holders 131, at least one connecting element 133 respectively fastened to an end of the link 132, and at least one axle 134 respectively mounted on the connecting elements 133.

The transmission mechanism 20 is mounted in one hollow stile 91 at one lateral side of the door 90 and coupled to one end of the control mechanism 10 at right angles, comprising a gear seat 21, which has an axle hole 22, which receives one axle 134 of the control mechanism 10, two vertical transmission rods 23 respectively pivoted to the gear seat 21 in reversed directions.

The bottom latch assembly 30 comprises a first shell 31 fixedly fastened to the hollow stile 91 on the inside near the bottom, and a bolt 32 inserted through the shell 31 and coupled to one vertical transmission rod 23.

Figure 5:
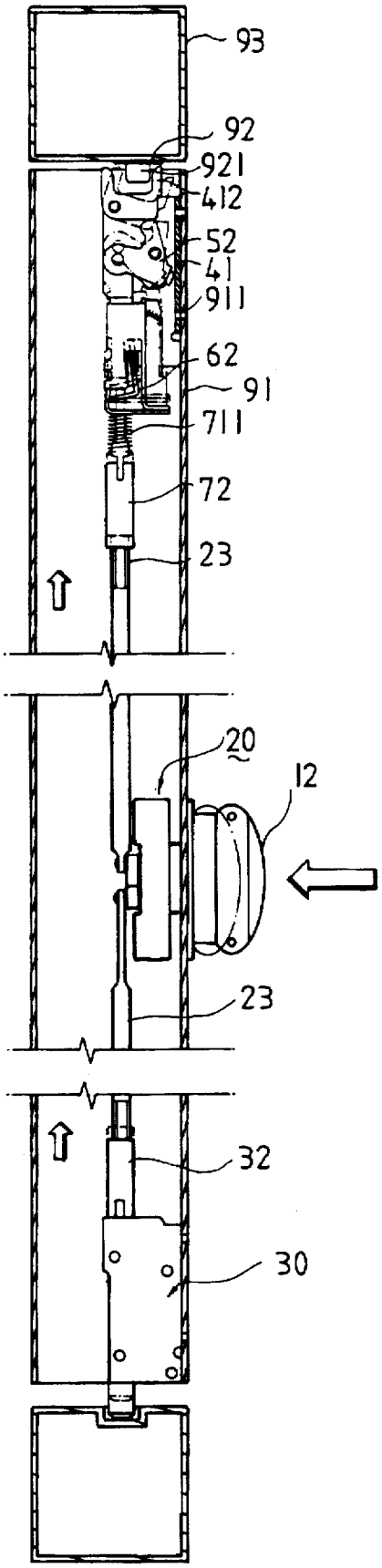
FIG. 5 is a sectional view of the present invention, showing the latch bolt of the top latch assembly and the bottom latch assembly moved between the locking position and the unlocking position.
Figure 6:
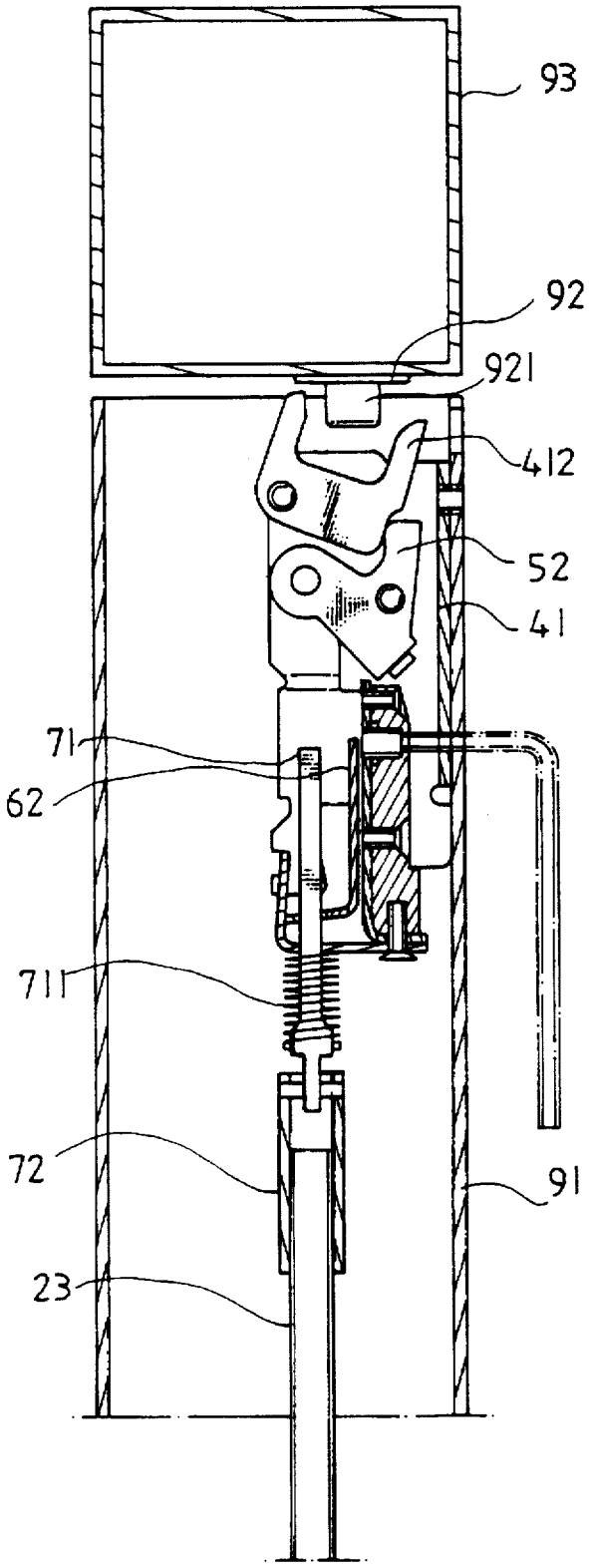
FIG. 6 is a sectional view of the present invention, showing the fine adjustment device to be disengaged from the upright extension strip of the second locating plate.
Figure 7:
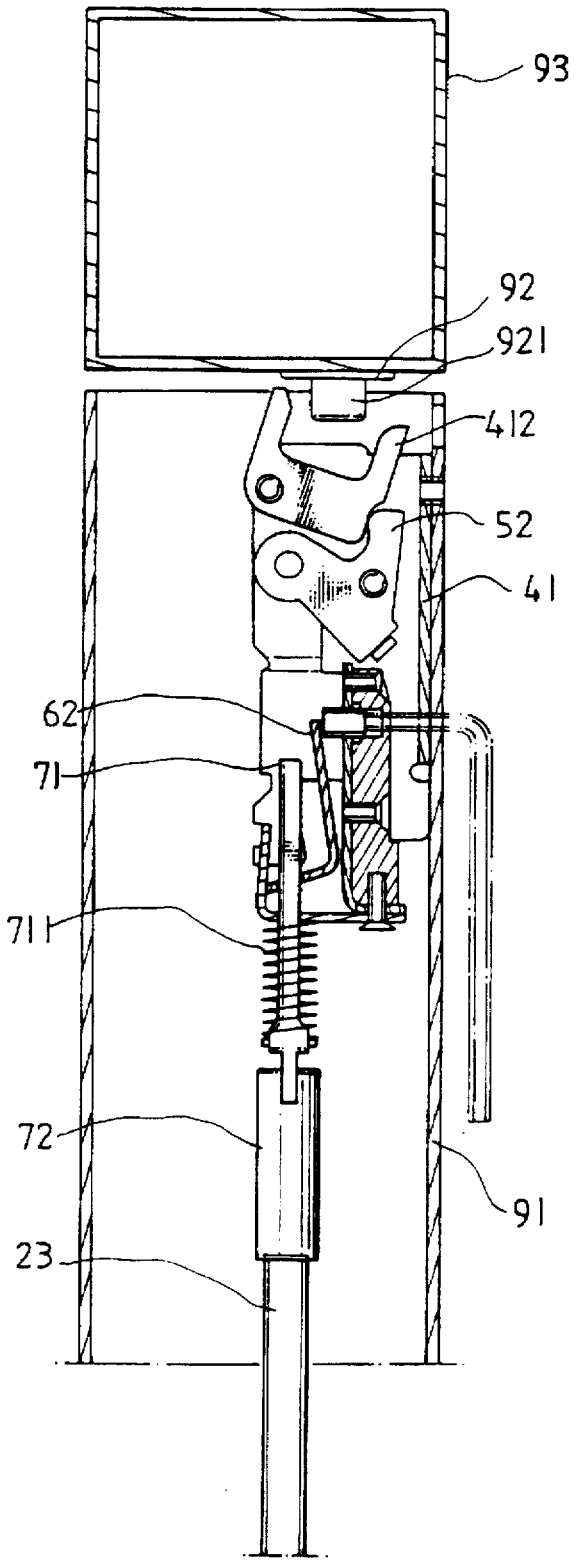
FIG. 7 is a sectional view of the present invention, showing the adjustment of the position of the movable rod then the engaging of the fine adjustment device to the upright extension strip of the second locating plate.
Figure 8:
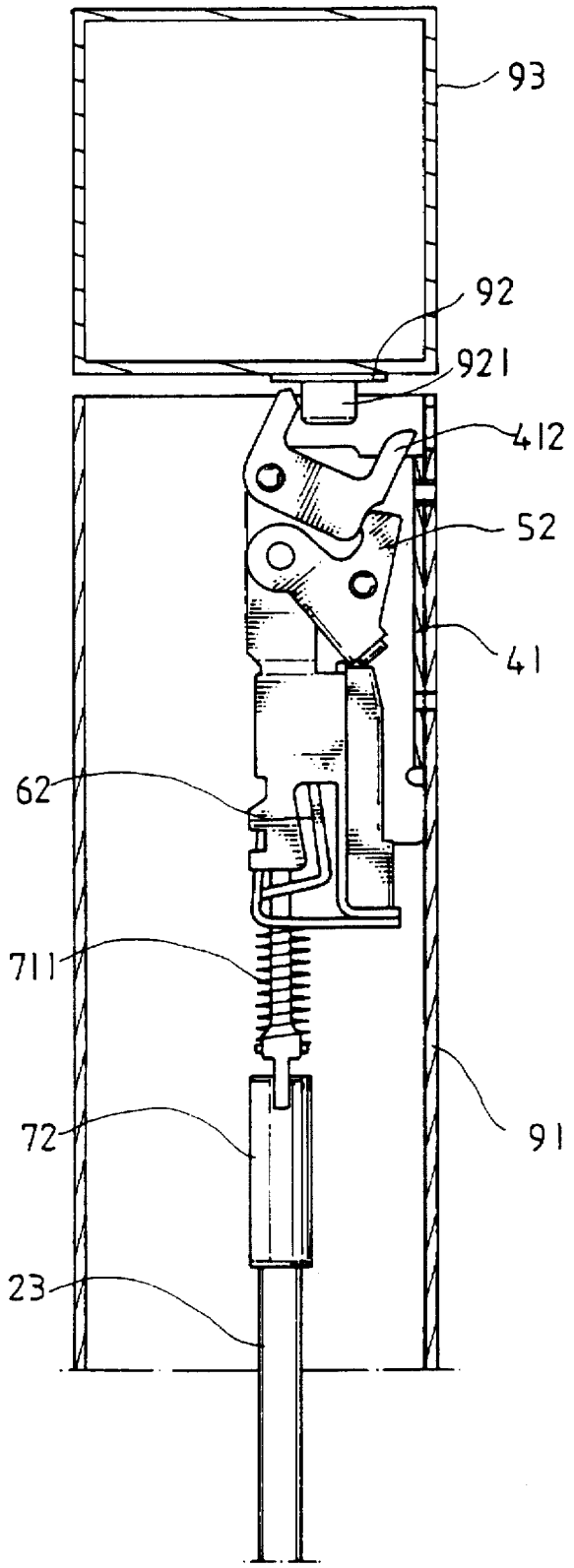
FIG. 8 is a sectional view of the present invention, showing the position of the latch bolt of the top latch assembly after adjustment.

The top latch assembly 40 is comprised of a second shell 41, a movable latch bolt 412, a frame 50, a push member 52, a locating device 60, an actuating device 70, and a fine adjustment device 80. The second shell 41 comprises two pivot holes 411 aligned at two opposite lateral sides thereof near the top, and two mounting screw holes 42 vertically spaced at a rear side thereof and respectively fastened to respective round holes 911 in the corresponding hollow stile 91 of the door 90 (see also FIG. 5). The movable latch bolt 412 has a pivot hole 413 connected between the pivot holes 411 of the second shell 41 by a pivot pin 414. The frame 50 is mounted inside the second shell 41 below the movable latch bolt 412, comprising a pivot 51 transversely disposed at the top, an opening 58 at the bottom, two screw holes 55 vertically spaced at a rear side thereof, and a fine adjustment hole 59 spaced between the screw holes 55. The push member 52 is pivotably mounted inside the second shell 41, having one end pivoted to the pivot 51, and a rubber cushion 521 at a back side thereof. Further, a side plate 53 is fastened to the rear side of the frame 50, having two screw holes 54 respectively connected to the screw holes 55 of the frame 50 by screws 541, and a fine adjustment hole 56 aligned with the fine adjustment hole 59 of the frame 50. The locating device 60 is comprised of a first locating plate 61, and a second locating plate 62. The first locating plate 61 comprises a vertical section 611 inserted into the opening 58 of the frame 50, a coupling slot 612 in the vertical section 611, a horizontal section 613 extending from the vertical section 611 at the bottom at right angles, a through hole 614 and a screw hole 615 spaced in the horizontal section 613. When the vertical section 611 of the first locating plate 61 is inserted into the opening 58 of the frame 50, the first locating plate 61 is fixedly secured to the side plate 53 by inserting a screw 616 through the screw hole 615 then screw hole 55. The second locating plate 62 comprises a vertical section 621 inserted into an opening 57 in the frame 50, an upright extension strip 622 extending from the vertical section 621 at the top, a horizontal section 623 extending from the vertical section 621 at the bottom at right angles and inserted into the coupling slot 612 of the first locating plate 61, and a through hole 624 aligned with the through hole 614 of the first locating plate 61. The actuating device 70 comprises a socket 72 coupled to one transmission rod 23 at the top, a movable rod 71 having one end pivoted to the socket 72 and an opposite end inserted through the through hole 614 of the first locating plate 61 and the through hole 624 of the second locating plate 62, and spring means for example a spring coil 711 mounted around the movable rod 71 and retained between the socket 72 and the first locating plate 61. The fine adjustment device 80 is for example an adjustment screw threaded into the fine adjustment hole 56 of the side plate 53 and the fine adjustment hole 59 of the frame 50, and stopped against the upright extension strip 622 of the second locating plate 62 of the locating device 60. When the fine adjustment device 80 is loosened, the movable rod 71 can be conveniently adjusted to the desired position by moving the movable rod 71 up or down. When adjusted, the fine adjustment device 80 is fastened tight and firmly stopped against the upright extension strip 622 of the second locating plate 62, causing the horizontal section 623 of the second locating plate 62 to be firmly secured to the coupling slot 612 of the first locating plate 61, and therefore the movable rod 71 is firmed retained between the first locating plate 61 and the second locating plate 62 at the adjusted position (see FIGS. 6 and 7).

Referring to FIGS. 1, 3, and 4 again, when installs the lock system,the control mechanism 10 is transversely fastened to the door 90 in the middle, then the transmission mechanism 20 is inserted into one hollow stile 91 of the door 90 and fixed in place, permitting the gear seat 21 of the transmission mechanism 20 to be coupled to one transverse axle 134 of the linking mechanism 13, and then the shell 31 of the bottom latch assembly 30 is fixedly mounted in the hollow stile 91 of the door 90 at the bottom, permitting the bolt 32 of the bottom latch assembly 30 to be fastened to the corresponding transmission rod 23 of the transmission mechanism 20, and then a strike plate 92 is fixedly mounted in the doorframe 93 for catching the latch bolt 412 of the top latch assembly 40. The strike plate 92 has a downward retaining rod 921 adapted for engaging the latch bolt 412 to secure the door 90 to the doorframe 93.

Referring to FIGS. from 3 to 8 and FIG. 1 again, when the position of the latch bolt 412 is either too high or too low causing the door not to be opened or closed, then the user wishes to adjust the latch bolt 412 to a suitable location. The following is an example to introduce how to adjust the latch bolt 412 to a suitable location when the poition of the latch bolt 412 is to high to block the door 90 from opening, first the pressure plate 12 is pressed down on the casing 11, then the bottom latch assembly 30 is fixed to the hollow stile 91 near the bottom, and one of the screw holes 42 of the top latch assembly 40 is fastened to respective hole 911 in the hollow stile 91 near the top for temporary fixation, and then a tool (not shown) is inserted into the lock hole 121 to fix the pressure plate 12 to the casing 11. When the pressure plate 12 is retained in the depressed position, the connecting elements 133 are moved by the link 132 to turn the axle 134, thereby causing the transmission rods 23 of the transmission mechanism 20 to be moved upwards. When the transmission rods 23 are moved upwards, the actuating device 70 of the top latch assembly 40 and the bolt 32 of the bottom latch assembly 30 are relatively lifted. When the actuating device 70 of the top latch assembly 40 and the bolt 32 of the bottom latch assembly 30 are relatively lifted, the bolt 32 is received back inside the hollow stile 91, then disengages the fine adjustment device 80 from the upright extension strip 622 of the second locating plate 62 by using a tool, permitting the movable rod 71 of the actuating device 70 to be pulled downwards. When the movable rod 71 of the actuating device 70 is down, the fine adjustment device 80 is turned inwards to be stopped at the upright extension strip 622 of the second locating plate 62, thereby causing the movable rod 71 of the actuating device 70 to be retained between the first locating plate 61 and the second locating plate 62 (see FIG. 7),the push member 52 is forced to change its original position to push the latch bolt 412, causing the latch bolt 412 to be turned downwardly away from the retainer rod 921 of the strike plate 92 and received back inside the hollow stile 91 (see FIGS. 6 and 7). When the latch bolt 412 is disengaged from the strike plate 92, the second shell 41 of the top latch assembly 40 is completely fixed to the hollow stile 91.

It is to be understood that the drawings are designed for purposes of illustration only, and are not intended as a definition of the limits and scope of the invention disclosed.

What the invention claimed is:

1. A door lock system comprising:

a control mechanism transversely mounted in a door in the middle, said control mechanism comprising an elongated casing fixedly mounted on said door in a horizontal position, a movable pressure plate coupled to said casing, and a linking mechanism mounted inside said casing and coupled to said movable pressure plate;

a transmission mechanism mounted in one hollow stile at one lateral side of said door and coupled to the linking mechanism of said control mechanism at one end at right angles, said transmission mechanism comprising a top transmission rod and a bottom transmission rod vertically disposed in reversed directions;

a bottom latch assembly mounted in said hollow stile near the bottom, said bottom latch assembly comprising a first shell fixedly fastened to said hollow stile on the inside near the bottom, and a bolt inserted through the first shell of said bottom latch assembly and coupled to the bottom transmission rod of said transmission mechanism; and a top latch assembly mounted in said hollow stile near the top and coupled to the top transmission rod of said transmission mechanism;

wherein said top latch assembly comprises:

a second shell mounted inside said hollow stile and having at least one mounting hole adapted for fastening to a respective mounting hole in said hollow stile;

a movable latch bolt pivoted to the second shell of said top latch assembly and adapted for engaging a retainer rod in a catch plate in a door frame to secure said door to said door frame;

a frame mounted in the second shell of said top latch assembly, said frame comprising a pivot transversely disposed at a top side thereof, a mounting notch, a bottom opening, a plurality of screw holes vertically spaced at a rear side thereof and adapted for fastening to said hollow stile, and a fine adjustment hole spaced between the screw holes of said frame;

a push member having one end pivoted to the second shell of said top latch assembly, and an opposite end pivoted to the pivot of the frame of said top latch assembly;

a locating device mounted in the frame of said top latch assembly, said locating device comprised of a first locating plate, and a second locating plate, said first locating plate comprising a vertical section inserted into the mounting notch of the frame of said top latch assembly, a coupling slot in the vertical section of said first locating plate, a horizontal section extending from a bottom side of the vertical section of said first locating plate at right angles, a through hole and a screw hole spaced in the horizontal section, the screw hole of the horizontal section of said first locating plate being fixedly secured to the frame of said top latch assembly by a screw, said second locating plate comprising a vertical section inserted into the bottom opening of the frame of said top latch assembly, an upright extension strip extending from a top side of the vertical section of said second locating plate the top, a horizontal section extending from a bottom side of the vertical section of said second locating plate at right angles and inserted into the coupling slot of said first locating plate, and a through hole aligned with the through hole of said first locating plate;

an actuating device, said adjustment device comprising a socket coupled to said top transmission rod of said transmission mechanism, a movable rod having one end pivoted to said socket and an opposite end inserted through the through hole of said first locating plate and the through hole of said second locating plate;

a fine adjustment device mounted in the fine adjustment hole of the frame of said top latch assembly, and adapted for stopping against the upright extension strip of said second locating plate of said locating device for securing the movable rod of said actuating device to said locating device;

said latch bolt of said top latch assembly is driven by said transmission mechanism to turn downward from said catch plate when the pressure plate of said control mechanism is depressed to move said link, permitting said fine adjustment device to be adjusted for letting the movable rod of said adjustment device be moved vertically to the desired position and then fixed in the adjusted position by fastening tight said fine adjustment device again.

2. The door lock system of claim 1 wherein said top latch assembly further comprises a side plate fastened to the frame of said top latch assembly at one side, said side plate comprising a plurality of screw holes respectively connected to the screw holes of the frame of said top latch assembly by respective screws, and a fine adjustment hole aligned with the fine adjustment hole of the frame of said top latch assembly and adapted for receiving said fine adjustment device.

3. The door lock system of claim 1 wherein said top latch assembly further comprising spring means mounted around said movable rod and retained between said socket and the first locating plate of said locating device.

4. The door lock system of claim 3 wherein said spring means is a spring coil.

* * * * *